US005721604A

United States Patent [19]

Ozaki

[11] Patent Number: 5,721,604

[45] Date of Patent: Feb. 24, 1998

[54] METHOD OF AND APPARATUS FOR FEEDING SCANNED MEDIUM

[75] Inventor: Takao Ozaki, Kanagawa-ken, Japan

[73] Assignee: Fuji Photo Film Co., Ltd., Kanagawa, Japan

[21] Appl. No.: 648,823

[22] Filed: May 16, 1996

[30] Foreign Application Priority Data

May 17, 1995 [JP] Japan ..... 7118372

[51] Int. Cl.[6] ..... G03B 27/58; B65H 20/00; G02B 5/30

[52] U.S. Cl. ..... 355/47; 226/91; 226/183; 358/493

[58] Field of Search ..... 355/47, 48; 226/91, 226/92, 183, 186; 358/493

[56] References Cited

U.S. PATENT DOCUMENTS

| | | | |
|---|---|---|---|
| 2,858,130 | 10/1958 | Baur et al. | 226/183 |
| 3,333,783 | 8/1967 | Guernet | 226/91 X |
| 3,669,331 | 6/1972 | Renold | 226/183 X |
| 3,985,277 | 10/1976 | Wright | 226/183 X |
| 4,129,469 | 12/1978 | Deverell et al. | 226/91 X |
| 5,103,322 | 4/1992 | Beck et al. | 355/47 X |
| 5,463,444 | 10/1995 | Watanabe et al. | 355/27 |

*Primary Examiner*—Fred L Braun

*Attorney, Agent, or Firm*—Sughrue, Mion, Zinn, Macpeak & Seas, PLLC

[57] ABSTRACT

A feeding apparatus has a rotatable feed drum and first and second nip rollers movable into rolling contact with an outer circumferential surface of the feed drum by gravity. The first nip roller is made of a metal, and the second nip roller is made of rubber, so that the first nip roller exerts feeding forces smaller than feeding forces exerted by the second nip roller. A film that is fed by the feed drum in coaction with the first and second nip rollers is reliably prevented from being lifted off the outer circumferential surface of the feed drum.

13 Claims, 7 Drawing Sheets

METHOD OF AND APPARATUS FOR FEEDING SCANNED MEDIUM

BACKGROUND OF THE INVENTION

1. Field of the Invention

The present invention relates to a method of and an apparatus for feeding a scanned medium in an auxiliary direction with a rotatable feed drum and two nip rollers which sandwich the scanned medium.

2. Description of the Related Art

There have been used recording apparatus for recording images on scanned mediums and reading apparatus for photoelectrically reading image information from scanned mediums. In such recording apparatus and reading apparatus, a light beam emitted by a light beam generator is applied to scan a medium in a main scanning direction by a light beam deflector and a scanning lens, and the scanned medium is fed in an auxiliary scanning direction substantially perpendicular to the main scanning direction by an auxiliary scanning mechanism for thereby recording an image on or reading an image from the scanned medium.

The auxiliary scanning mechanism which is of the type widely used in the art comprises a rotatable feed drum and two nip rollers movable toward and away from the rotatable feed drum for sandwiching a scanned medium for smoothly feeding the scanned medium in the auxiliary scanning direction.

While the scanned medium is being pressed against an outer circumferential surface of the feed drum by the two nip rollers or the scanned medium is being fed by rotation of the feed drum, the scanned medium often tends to slack due to gravity, curvature, or other external forces applied thereto. Therefore, the scanned medium as it is fed by the feed drum is liable to be lifted off the feed drum or move in a tortuous path. When the scanned medium is thus lifted off the feed drum or moves in a tortuous path, any straight line recorded on the scanned medium by exposure to a light beam is unduly curved in the direction in which the scanned medium is fed or in the direction transverse thereto.

SUMMARY OF THE INVENTION

It is a primary object of the present invention to provide a method of and an apparatus for feeding a scanned medium highly accurately with a feed drum and nip rollers by easily and reliably bringing the scanned medium into contact with an outer circumferential surface of the feed drum.

The above and other objects, features, and advantages of the present invention will become more apparent from the following description when taken in conjunction with the accompanying drawings in which a preferred embodiment of the present invention is shown by way of illustrative example.

DETAILED DESCRIPTION OF THE PREFERRED EMBODIMENT

Figure 1:
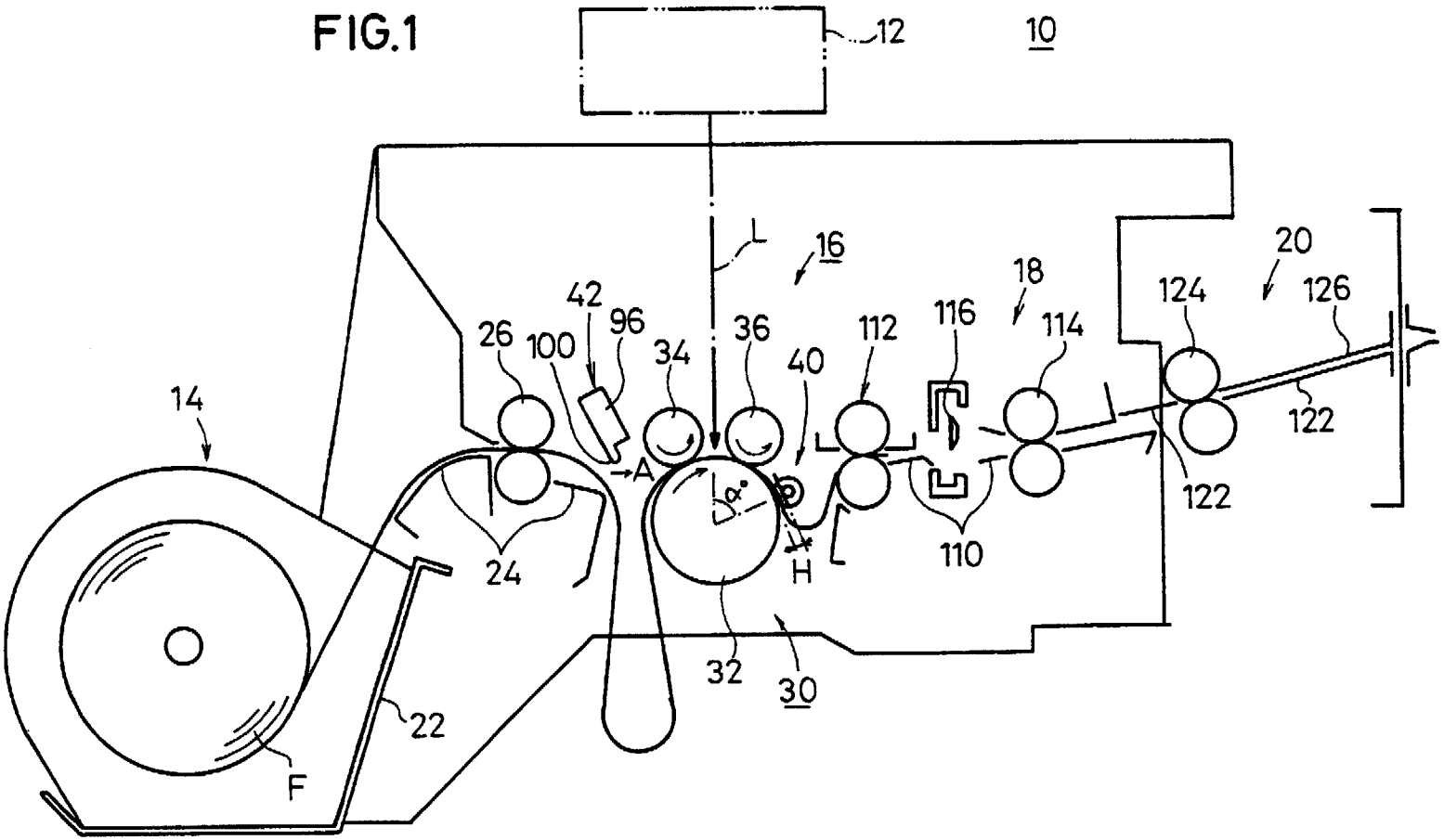
FIG. 1 is a schematic side elevational view of a recording apparatus which incorporates a feeding apparatus according to the present invention.

As shown in FIG. 1, a feeding apparatus according to the present invention is incorporated in a recording apparatus, generally denoted by the reference numeral 10. The recording apparatus 10 comprises a light beam generator 12 for generating a recording light beam L such as a laser beam, a film supply 14 for unfeeling and supplying a photographic film F (scanned medium) from a film roll, a recorder 16 for recording an image on the film F supplied from the film supply 14, a film feeder and cutter 18 for feeding and cutting off the recorded film F to a predetermined length, and a film discharger 20 for discharging the cut length of film F to an image developing apparatus (not shown).

The film supply 14 comprises a magazine 22 which accommodates the film roll, a plurality of guides 24 for guiding the film F supplied from the film roll, and a first feed roller pair 26 for gripping a leading end of the film F and feeding the film F toward the recorder 16. The recorder 16 includes the feeding apparatus, generally denoted by the reference numeral 30, according to the present invention, for feeding the film F in an auxiliary scanning direction indicated by the arrow A which is substantially perpendicular to a main scanning direction in which the film F is scanned by the light beam L.

Figure 2:
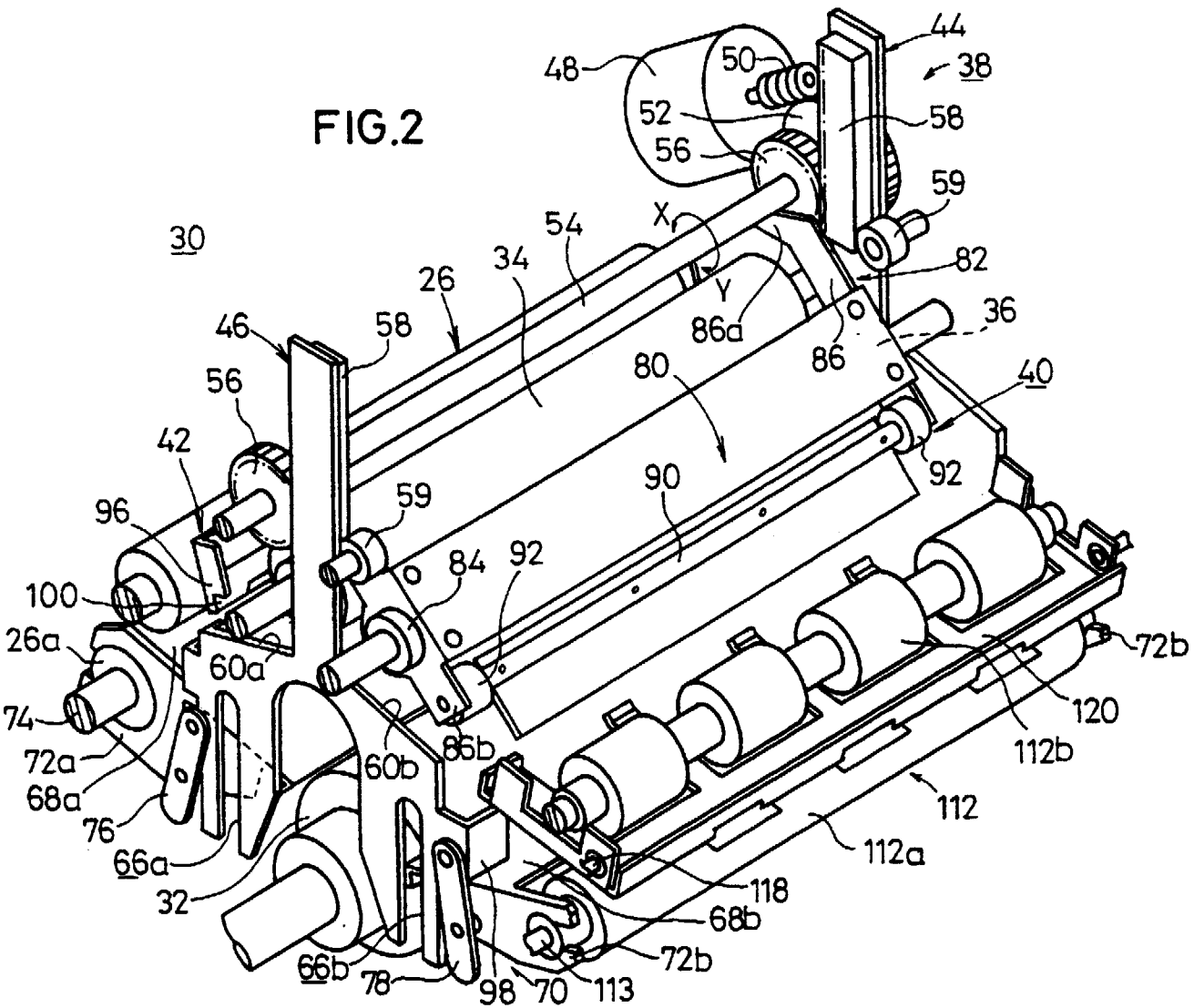
FIG. 2 is a perspective view of the feeding apparatus.

As shown in FIGS. 1 and 2, the feeding apparatus 30 comprises a rotatable feed drum 32 of relatively large diameter which is disposed in an exposure position where the light beam L is applied from the light beam generator 12 that is positioned above the feeding apparatus 30, and first and second nip rollers 34, 36 disposed one on each side of the exposure position and movable into rolling contact with an outer circumferential surface of the feed drum 32 by gravity.

The first nip roller 34 is positioned upstream of the exposure position with respect to the auxiliary scanning direction indicated by the arrow A. The first nip roller 34 is arranged to exert feeding forces smaller than feeding forces that can be exerted by the second nip roller 36 that is positioned downstream of the exposure position with respect to the auxiliary scanning direction indicated by the arrow A. In the illustrated embodiment, specifically, the first nip roller 34 is made of a metal such as aluminum, and the second nip roller 36 is made of rubber to produce such different feeding forces.

The feeding apparatus 30 comprises a displacing mechanism 38 for moving the first and second nip rollers 36 vertically toward and away from the feed drum 32, a winding mechanism 40 for winding the film F around the outer circumferential surface of the feed drum 32 at a position downstream of the second nip roller 36 with respect to the auxiliary scanning direction indicated by the arrow A, and a guide mechanism 42 positioned upstream of the first nip roller 34 with respect to the auxiliary scanning direction indicated by the arrow A, for guiding the film F onto the outer circumferential surface of the feed drum 32.

As shown in FIG. 2, the displacing mechanism 38 comprises a pair of brackets 44, 46 spaced from each other in a direction transverse to the auxiliary scanning direction indicated by the arrow A, and a stepping motor (drive source) 48 for lifting and lowering the brackets 44, 46 in unison with each other. The stepping motor 48 has a rotatable drive shaft to which there is fixed a worm 50 held in mesh with a worm gear 52 mounted on an end of a rotatable shaft 54. A pair of spaced spur gears 56, 56 is mounted on the rotatable shaft 54 and held in mesh with respective racks 58 fixed to respective upper ends of the brackets 44, 46. The racks 58 are held against respective guide rollers 59 which guide vertical movement of the racks 58.

Figure 4:
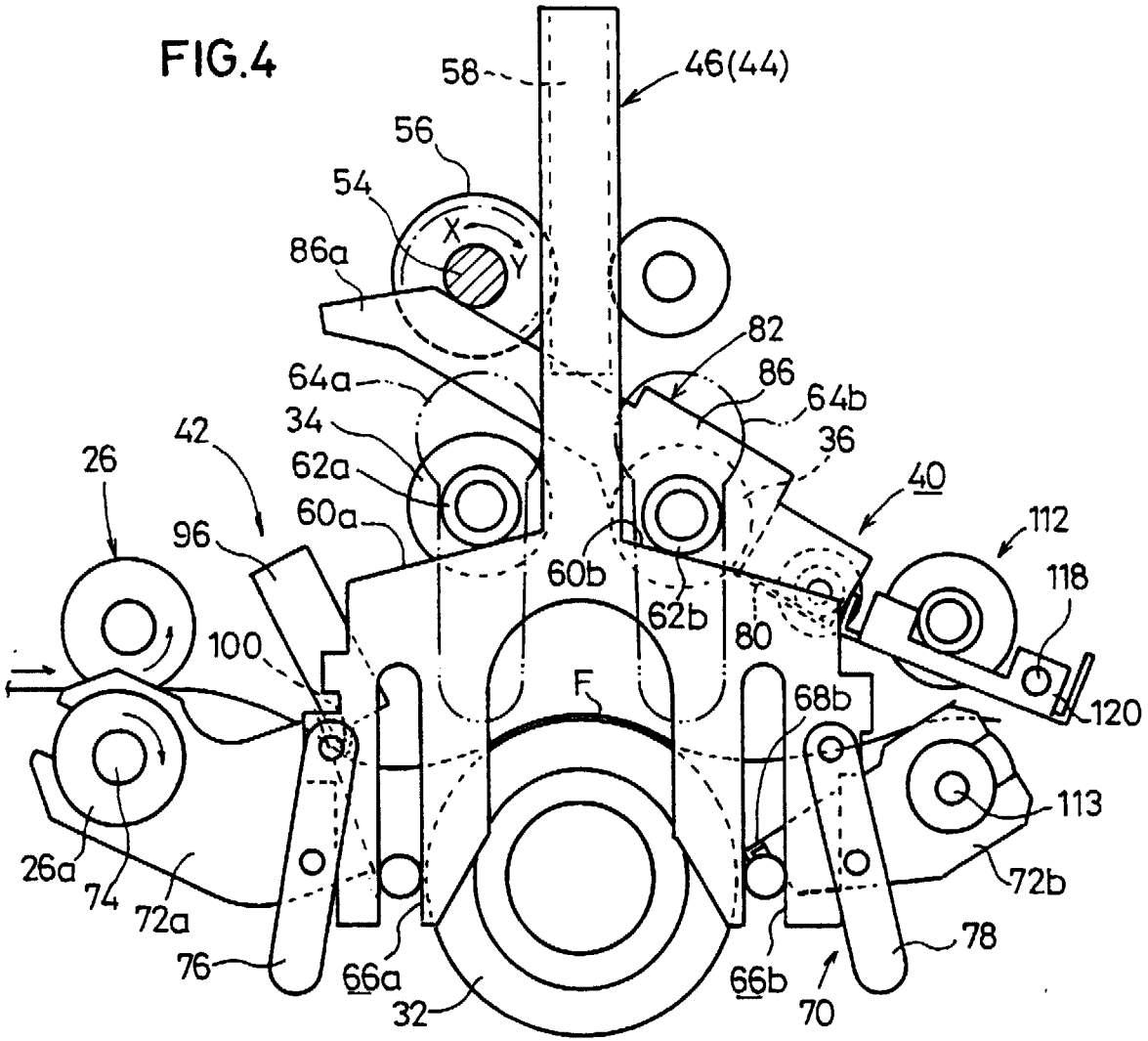
FIG. 4 is a side elevational view of the feeding apparatus, showing a stage of operation in which nip rollers are disposed in an uppermost position.

Each of the brackets 44, 46 is in the form of a vertical plate and has a laterally branched lower end portion including a pair of shoulders 60*a*, 60*b* supporting respective ends of the first and second nip rollers 34, 36 thereon. As shown in FIG. 4, the shoulders 60*a*, 60*b* are slanted downwardly in outward directions away from each other. The shoulder 60*a* on which the first nip roller 34 is placed is higher than the shoulder 60*b* on which the second nip roller 36 is placed. The first and second nip rollers 34, 36 placed on the respective shoulders 60*a*, 60*b* are supported on outer wall surfaces of vertically elongate guide grooves 64*a*, 64*b* by bearings 62*a*, 62*b* mounted on the respective ends of the first and second nip rollers 34, 36.

Each of the brackets 44, 46 has a pair of downwardly open, vertically elongate slots 66*a*, 66*b* defined in the lower end portions thereof. A switching mechanism 70 is mounted on the lower end portions of the brackets 44, 46 for angularly moving upstream and downstream guide plates 68*a*, 68*b*, positioned one on each side of the feed drum 32, in response to vertical movement of the first and second nip rollers 34, 36 to switch between a linear feed path which extends substantially straight from the first feed roller pair 26 over the feed drum 32 to the second feed roller pair 112 and a looped feed path which extends downwardly between the upstream and downstream guide plates 68*a*, 68*b* and the feed drum 32, as shown in FIG. 1.

The switching mechanism 70 has a pair of upstream and downstream swing plates 72*a*, 72*b* disposed respectively upstream and downstream of the feed drum 32. The upstream swing plate 72*a* has an end swingably supported on a shaft 74 of a drive roller 26*a* of the first feed roller pair 26, and a link 76 which engages an opposite end of the upstream swing plate 72*a* is angularly movably mounted on the brackets 44, 46. The upstream swing plate 72*a* is fixed to the upstream guide plate 68*a*.

The downstream swing plate 72*b* has an end swingably supported on a shaft 113 of a drive roller 112*a* of a second feed roller pair 112 (described later on), and a link 78 which engages an opposite end of the downstream swing plate 72*b* is angularly movably mounted on the brackets 44, 46. The downstream swing plate 72*b* is fixed to the downstream guide plate 68*b*.

Figure 3:
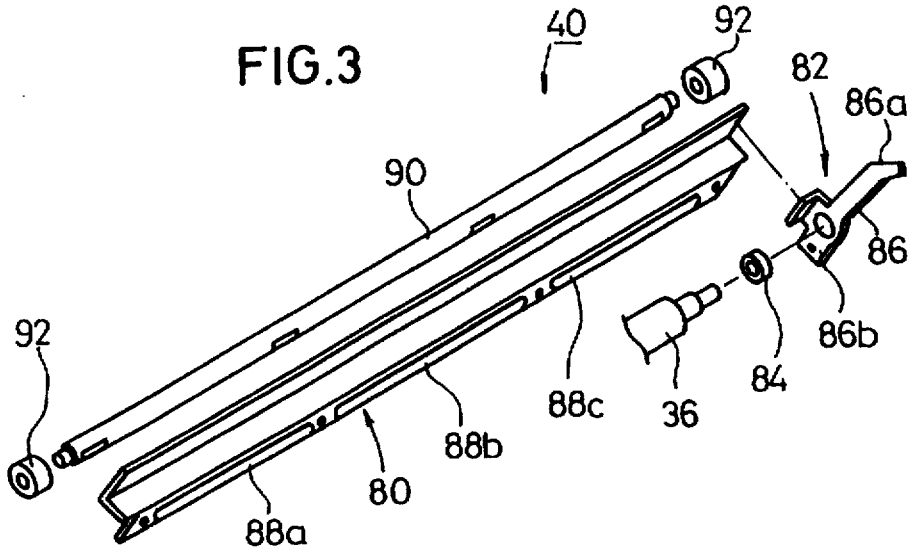
FIG. 3 is an exploded perspective view of a winding mechanism of the feeding apparatus.

As shown in FIGS. 2 through 4, the winding mechanism 40 comprises a guide bar 80 which is elongate in the axial direction of the feed drum 32, and a displacing mechanism 82 for moving the guide bar 80 toward and away from the outer circumferential surface of the feed drum 32.

The displacing mechanism 82 has a pair of arms 86 swingably mounted on the respective opposite ends of the second nip roller 36 by respective bearings 84. Each of the arms 86 has a sharp end 86*a* held against the rotatable shaft 54. The guide bar 80 has opposite ends fixed to the arms 86, respectively.

The guide bar 80 is of an angular cross-sectional shape and includes a portion directed toward the feed drum 32 and having a plurality of elongate lands 88*a*, 88*b*, 88*c* extending axially of the feed drum 32. A backup rod 90 is fixed to the guide bar 80 behind the elongate lands 88*a*, 88*b*, 88*c*, and rollers 92 are mounted on respective opposite ends of the backup rod 90. The backup rod 90 and the rollers 92 are held on other ends 86*b* of the arms 86. The rollers 92 will be held in direct rolling contact with the outer circumferential surface of the feed drum 32 outside of the transverse dimension of the film F for lifting the elongate lands 88*a*, 88*b*, 88*c* off the outer circumferential surface of the feed drum 32 by a predetermined distance H (see FIG. 1).

As shown in FIGS. 2 and 4, the guide mechanism 42 has a guide plate 96 fixed in position which extends axially of the feed drum 32. The guide plate 96 has a plurality of separate plate-like pressers 100 having their tip ends positioned lower than the uppermost position of the outer circumferential surface of the feed drum 32.

As shown in FIG. 1, the film feeder and cutter 18 comprises a plurality of guide plates 110, second and third feed roller pairs 112, 114 spaced from each other, and a cutter 116 disposed between the second and third feed roller pairs 112, 114.

The second roller pair 112 comprises a drive roller 112*a* and a driven roller 112*b*. As shown in FIGS. 2 and 4, the driven roller 112*b* is supported by a swingable guide plate 120 which is swingable about shafts 118 mounted on an end thereof. The other end of the guide plate 120 is engageable with downstream engaging fingers 98 of the brackets 44, 46. In response to vertical movement of the brackets 44, 46, the swingable guide plate 120 swing to move the driven roller 112*b* toward and away from the drive roller 112*a*.

As shown in FIG. 1, the film discharger 20 comprises a plurality of guide plates 122, a fourth feed roller pair 124, and a shutter 126 for selectively opening and closing a passage which leads to the image develop apparatus (not shown).

Operation of the recording apparatus 10 of the above structure will be described below in relation to a feeding method according to the present invention.

The rolled film F is housed in the magazine 22, and the leading end of the film F is gripped by the first feed roller pair 26. The first and second nip rollers 34, 36 are spaced away from the feed drum 32, the driven roller 112*b* of the second feed roller pair 112 is spaced from the feed drum 32, and the winding mechanism 40 is spaced from the feed drum 32 (see FIG. 4).

Specifically, as shown in FIG. 2, the stepping motor 48 is energized to cause the worm 50 and the worm gear 52 to rotate the rotatable shaft 54 in the direction indicated by the arrow X. The spur gears 56 mounted on the rotatable shaft 54 rotate, elevating the racks 58 meshing therewith and the brackets 44, 46 to which the racks 58 are fixed. The first and second nip rollers 34, 36 placed on the shoulders 60*a*, 60*b* of the brackets 44, 46 are now lifted off the feed drum 32, with the first nip roller 34 supported lower than the second nip roller 36 (see FIG. 4).

The upstream and downstream guide plates 68*a*, 68*b* are angularly moved upwardly by the links 76, 78, and kept in a desired attitude. The swingable guide plate 120 is swung upwardly about the shafts 118 by engagement with the downstream engaging fingers 98 of the brackets 44, 46, and the driven roller 112*b* supported on the swingable guide plate 120 is moved upwardly away from the drive roller 112*a*.

The ascending movement of the brackets 44, 46 causes the arms 86 of the winding mechanism 40 to ascend in unison with the second nip roller 36 with the ends 86*a* engaged by the rotatable shaft 54. Therefore, the other ends 86b of the arms 86 are angularly moved upwardly about the rotatable shaft 54, and the guide bar 80 fixed to the arms 86 is moved along an arcuate path away from the outer circumferential surface of the feed drum 32.

When the film F is drawn from the magazine 22 by the first feed roller pair 26 as it rotates, the leading end of the film F is guided by the plate-like pressers 100 to move toward the feed drum 32. Because the tip ends of the plate-like pressers 100 are positioned lower than the uppermost position of the outer circumferential surface of the feed drum 32, the leading end of the film F is reliably brought into contact with the outer circumferential surface of the feed drum 32 (see FIG. 4).

Figure 5:
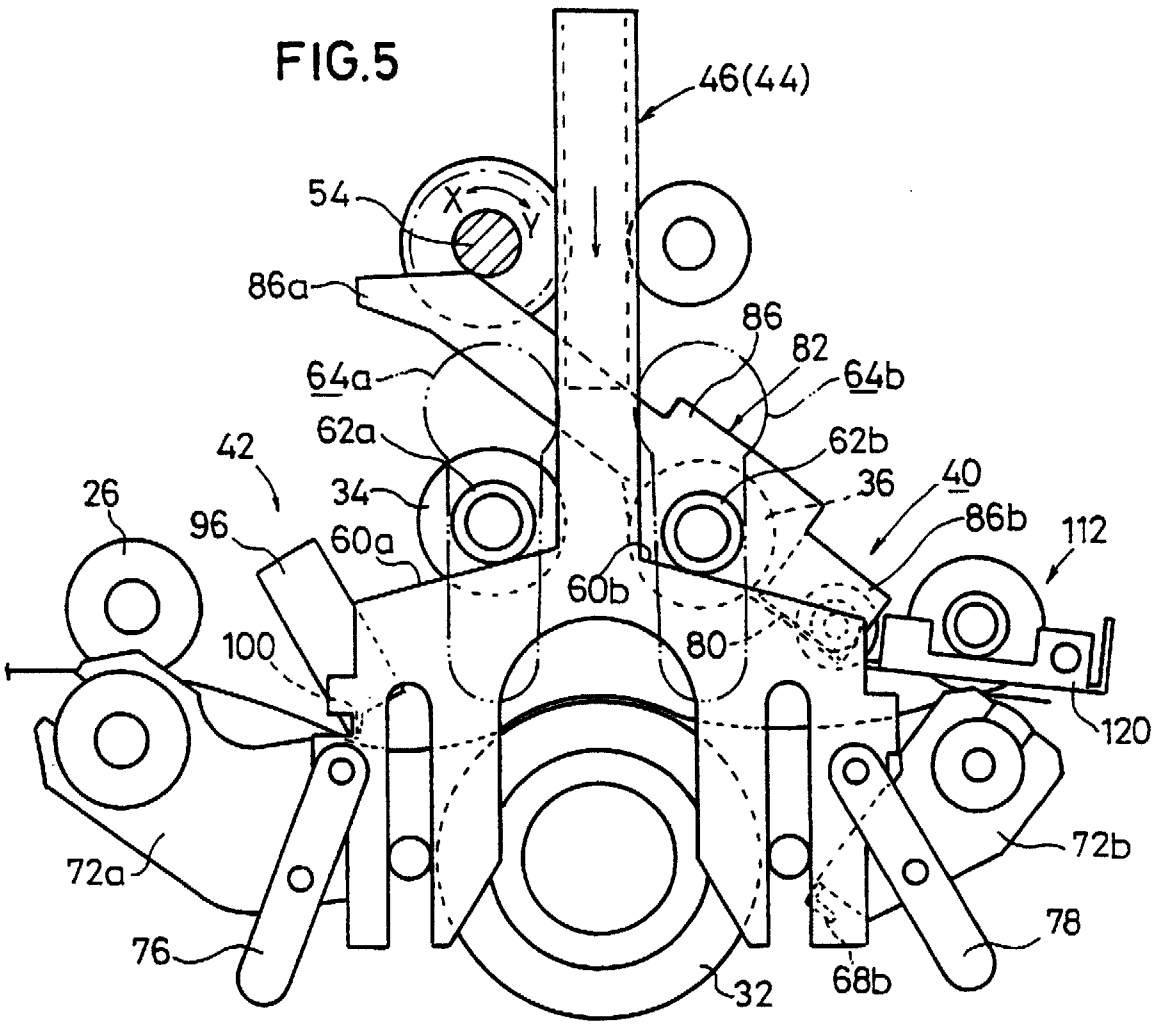
FIG. 5 is a side elevational view of the feeding apparatus, showing a stage of operation in which the nip rollers start descending.
Figure 6:
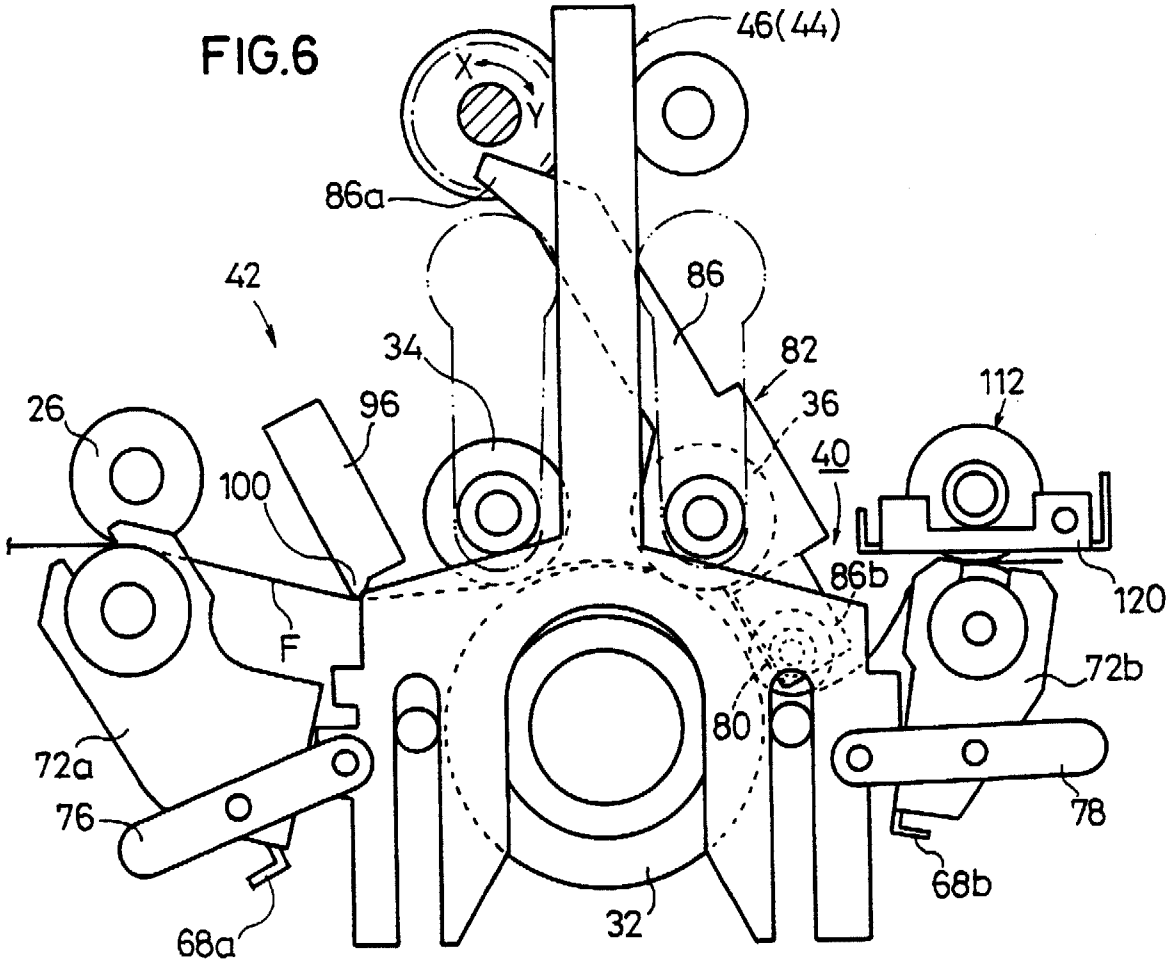
FIG. 6 is a side elevational view of the feeding apparatus, showing a stage of operation in which one of the nip rollers is placed on a feed drum.

The stepping motor 48 is now reversed to rotate the rotatable shaft 54 in the direction indicated by the arrow Y (FIG. 2), whereupon the brackets 44, 46 start descending (see FIG. 5). As the brackets 44, 46 move downwardly, the first and second nip rollers 34, 36 placed on the shoulders 60a, 60b are lowered. First, the second nip roller 36 is placed on the outer circumferential surface of the feed drum 32 by gravity, sandwiching the leading end of the film F between the feed drum 32 and the second nip roller 36 (see FIG. 6).

The swingable guide plate 120 swings downwardly in unison with the downstream engaging fingers 98, bringing the driven roller 112b into rolling contact with the drive roller 112a. The upstream and downstream guide plates 68a, 68b swing downwardly, creating a looped feed path (see FIG. 1) between themselves and the feed drum 32.

On further downward movement of the brackets 44, 46, the arms 86 descend in unison with the first nip roller 34 with the ends 86a borne by the rotatable shaft 54, angularly displacing the other ends 86b toward the outer circumferential surface of the feed drum 32. Therefore, the guide bar 80 secured to the arms 86 moves along the arcuate path toward the feed drum 32 until the rollers 92 are held against the outer circumferential surface of the feed drum 32. The elongate lands 88a, 88b, 88c of the guide bar 80 are spaced from the outer circumferential surface of the feed drum 32 by a predetermined distance H.

Figure 7:
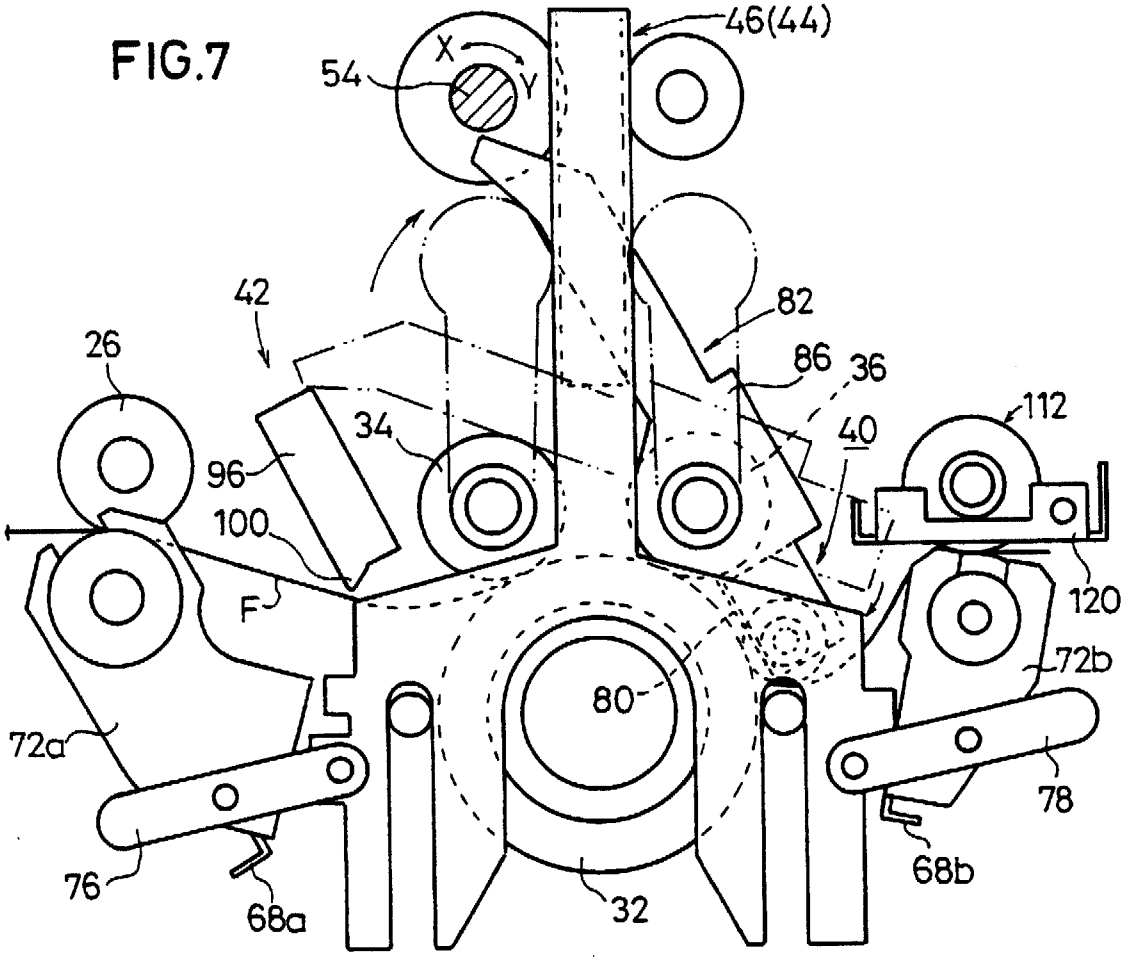
FIG. 7 is a side elevational view of the feeding apparatus, showing a stage of operation in which both the nip rollers are placed on the feed drum.

Then, as the brackets 44, 46 further descend, the first nip roller 34 contacts the outer circumferential surface of the feed drum 32 due to gravity, sandwiching the film F between the first nip roller 34 and the outer circumferential surface of the feed drum 32 (see FIG. 7).

When the film F is fed toward the recorder 16 in response to rotation of the first feed roller pair 26, the film F is drawn by a length required to record an image thereon between the feed drum 32 and the first feed roller pair 26, with the result that the guide mechanism 42 is spaced from the feed path of the film F (see FIG. 1).

The first feed roller pair 26 is then stopped against rotation, and the feed drum 32 is rotated about its own axis in the direction indicated by the arrow at a relatively low speed. The film F is now fed in the auxiliary scanning direction indicated by the arrow A while being sandwiched between the feed drum 32 and the first and second nip rollers 34, 36. At the same time, the film F is scanned in the main scanning direction by the light beam L emitted from the light beam generator 12 and modulated by image information. As a consequence, an image represented by the image information is two-dimensionally recorded on the film F.

In the illustrated embodiment, the first and second nip rollers 34, 36 placed respectively on the shoulders 60a, 60b of the brackets 44, 46 are disposed in different vertical positions, respectively. When the brackets 44, 46 are lowered, the film F which has been brought into contact with the outer circumferential surface of the feed drum 32 by being guided by the plate-like pressers 100 of the guide mechanism 42, is sandwiched first at its leading end between the second nip roller 36 and the feed drum 32, and then at its upstream portion between the first nip roller 34 and the feed drum 32.

Accordingly, the film F is reliably prevented from being displaced off the outer circumferential surface of the feed drum 32 between the first nip roller 34 and the second nip roller 36. Since the film F is thus held in intimate contact with the outer circumferential surface of the feed drum 32, any straight line recorded on the film F by exposure to the light beam L is prevented from being unduly curved.

Furthermore, the second nip roller 36 is made of rubber and the first nip roller 34 is made of a metal such as aluminum, so that the second nip roller 36 exerts feeding forces greater than feeding forces that can be exerted by the first nip roller 34. Therefore, when the feed drum 32 is rotated in the direction indicated by the arrow, the film A can reliably be fed in the direction indicated by the arrow A by the second nip roller 36 which is held in rolling contact with the outer circumferential surface of the feed drum 32 by gravity. The film F is thus not lifted off the outer circumferential surface of the feed drum 32 while being fed between the second nip roller 36 and the first nip roller 34.

As described above, the feeding forces exerted by the second nip roller 36 are made greater than the feeding forces exerted by the first nip roller 34 because the second nip roller 36 is made of rubber and the first nip roller 34 is made of a metal such as aluminum. However, the feeding forces exerted by the second nip roller 36 may be made greater than the feeding forces exerted by the first nip roller 34 by making the second nip roller 36 heavier than the first nip roller 34. In the illustrated embodiment, actually, the second nip roller 36 having an outer layer made of rubber is 1.5 to 3 times heavier than the first nip roller 34 made of aluminum.

Therefore, the film F is accurately fed in the direction indicated by the arrow A while being pressed against the outer circumferential surface of the feed drum 32 between the first and second nip rollers 34, 36. As a result, any straight line recorded on the film F by exposure to the light beam L is prevented from being unduly curved, and any image can precisely be recorded on the film F which is being fed by the feed drum 32 and the first and second nip rollers 34, 36.

In the illustrated embodiment, the winding mechanism 40 is positioned downstream of the second nip roller 36 with respect to the auxiliary scanning direction. The guide bar 80 of the winding mechanism 40 has its elongate lands 88a, 88b, 88c spaced a distance H from the outer circumferential surface of the feed drum 32 by the rollers 92 on the backup rod 90. The distance H is set to 1~2 mm, for example, depending on the thickness of the film F.

The winding mechanism 40 is effective in winding the film F around the outer circumferential surface of the feed drum 32 through an angle $\alpha$ of 70°, for example, from the exposure position where the light beam L is applied to the film F to a position downstream of the second nip roller 36 in the auxiliary scanning direction. Consequently, the second nip roller 36 remains in constant contact with the film F continuously from the time when an image starts being recorded on the film F to the time when the recording of the image on the film F is finished. The image can thus be recorded under constant conditions on the film F. Another advantage offered by the winding mechanism 40 is that inasmuch as the film F is held in contact with a relatively large area of the outer circumferential surface of the feed drum 32, the feed drum 32 can exert relatively large feeding forces to the film F.

While an image is being recorded on the film F, the recorded film F is accommodated between the second feed roller pair 112 and the feed drum 32. After the image has been recorded on the film F, the first feed roller pair 26, the feed drum 32, the second feed roller pair 112, the third feed roller pair 114, and the fourth feed roller pair 124 are simultaneously rotated to feed the film F to move an end of the recorded region of the film F toward the shutter 126.

The cutter 116 is actuated to cut off the film F to a predetermined length which contains the recorded region, after which the shutter 126 is opened and the severed recorded film F is delivered by the fourth feed roller 124 into the image developing apparatus. An unrecorded region of the film F which remains in the recorder 16 is fed back into the magazine 22.

While the fixed guide mechanism 42 is employed in the illustrated embodiment, a movable guide mechanism may be employed which can be retracted away from the feed path of the film F.

The feeding apparatus and the feeding method according to the present invention may be incorporated in a reading apparatus which applies a light beam to an original (film) with image information recorded thereon for photoelectrically reading the recorded image information.

The feeding apparatus and the feeding method according to the present invention offer the following advantages:

Since the leading end of a scanned medium is smoothly brought into rolling contact with the outer circumferential surface of the feed drum by being guided by the guide mechanism, the scanned medium is reliably held on the outer circumferential surface of the feed drum by the first and second nip rollers. The scanned medium is thus reliably prevented from being lifted off the outer circumferential surface of the feed drum between the first and second nip rollers.

Inasmuch as the feeding forces exerted by the first nip roller which is positioned upstream in the auxiliary scanning direction are smaller than the feeding forces exerted by the second nip roller which is positioned downstream in the auxiliary scanning direction, the scanned medium is prevented from being lifted or tortured between the first and second nip rollers. Consequently, the scanned medium can be fed highly precisely in the auxiliary scanning direction through a relatively simple mechanical arrangement.

Although a certain preferred embodiment of the present invention has been shown and described in detail, it should be understood that various changes and modifications may be made therein without departing from the scope of the appended claims.

What is claimed is:

1. A method of feeding a scanned medium with a rotatable feed drum and first and second nip rollers disposed one on each side of an exposure position in which a light beam deflected in a main scanning direction is applied to the scanned medium, the first nip roller being positioned upstream of the second nip roller with respect to an auxiliary scanning direction substantially perpendicular to the main scanning direction, said method comprising the ordered steps of:

guiding the scanned medium into contact with an outer circumferential surface of said feed drum with a guide member which is positioned upstream of said first nip roller with respect to said auxiliary scanning direction while inserting the scanned medium between said feed drum and said first and second nip rollers which are spaced from said feed drum;

moving the second nip roller towards the surface of the feed drum to sandwich a leading end of the scanned medium between the second nip roller and said feed drum;

moving the first nip roller towards the surface of the feed drum to sandwich the scanned medium between the first nip roller and said feed drum and moving said guide member relatively away from a feed path of the scanned medium while the leading end of the scanned medium is being sandwiched between the second nip roller and said feed drum; and rotating said feed drum to feed the scanned medium in said auxiliary scanning direction in coaction with said first and second nip rollers.

2. A method according to claim 1, wherein the first nip roller exerts feeding forces smaller than feeding forces exerted by the second nip roller in feeding the scanned medium in said auxiliary scanning direction.

3. A method according to claim 1, wherein when the leading end of the scanned medium is sandwiched between the second nip roller and said feed drum, the scanned medium is wound around the outer circumferential surface of said feed drum through an angle from said exposure position to a position downstream of the second nip roller with respect to said auxiliary scanning direction.

4. An apparatus for feeding a scanned medium, comprising;

a rotatable feed drum in an exposure position in which a light beam deflected in a main scanning direction is applied downwardly to the scanned medium; and first and second nip rollers disposed one on each side of said exposure position and movable into rolling contact with an outer circumferential surface of the feed drum by gravity, for feeding the scanned medium in an auxiliary scanning direction substantially perpendicular to the main scanning direction in response to rotation of the feed drum;

the first nip roller being positioned upstream of the second nip roller with respect to said auxiliary scanning direction, said first nip roller being arranged to exert feeding forces smaller than feeding forces exerted by the second nip roller.

5. An apparatus according to claim 4, wherein the first nip roller is made of a metal, and the second nip roller is made of rubber.

6. An apparatus according to claim 5, wherein the second nip roller is heavier than the first nip roller.

7. An apparatus according to claim 4, further comprising:

a winding mechanism for winding the scanned medium around the outer circumferential surface of the feed drum up to a position downstream of the second nip roller with respect to said auxiliary scanning direction;

said winding mechanism comprising;

a guide member for being spaced from the outer circumferential surface of the feed drum; and an arm for moving said guide member toward and away from the outer circumferential surface of the feed drum in said position downstream of the second nip roller.

8. An apparatus according to claim 7, wherein said guide member comprises a guide bar extending axially of said feed drum, said winding mechanism further comprising:

a backup rod extending axially of said feed drum and supporting said guide bar; and a pair of rollers mounted on said backup rod for being held in direct rolling contact with the outer circumferential surface of the feed drum outside of the transverse dimension of the film.

9. An apparatus according to claim 7, wherein said arm is fixed to said guide member and swingably mounted on an end of the second nip roller.

10. An apparatus according to claim 4, further comprising:

a guide member positioned upstream of the first nip roller with respect to said auxiliary scanning direction, for guiding the scanned medium into contact with the outer circumferential surface of the feed drum while said first and second nip rollers are being spaced from said feed drum.

11. An apparatus according to claim 4, further comprising:

a displacing mechanism for moving said first and second nip rollers vertically toward and away from said feed drum;

said displacing mechanism comprising a pair of brackets supporting ends of said first and second nip rollers; and a drive source for lifting and lowering said brackets.

12. An apparatus according to claim 11, wherein said brackets have respective shoulders slanted downwardly in directions away from each other, said first and second nip rollers being placed respectively on said shoulders, said shoulders supporting said first and second nip rollers such that the first nip roller is held in a position higher than the second nip roller.

13. An apparatus according to claim 11, further comprising upstream and downstream guide members disposed one on each side of said feed drum and angularly movably engaging said brackets, respectively, for switching between a linear feed path over said feed drum and a looped feed path between said upstream and downstream guide members and said feed drum in response to vertical movement of said brackets.

* * * * *